US010463578B2

(12) United States Patent
Evans et al.

(10) Patent No.: US 10,463,578 B2
(45) Date of Patent: Nov. 5, 2019

(54) FLAVOR OR SCENT CARRYING PACIFIER OR TEETHING RING

(71) Applicants: Jeff Evans, Omaha, NE (US); Mollie Evans, Omaha, NE (US)

(72) Inventors: Jeff Evans, Omaha, NE (US); Mollie Evans, Omaha, NE (US)

( * ) Notice: Subject to any disclaimer, the term of this patent is extended or adjusted under 35 U.S.C. 154(b) by 88 days.

(21) Appl. No.: 15/926,875

(22) Filed: Mar. 20, 2018

(65) Prior Publication Data

US 2019/0290548 A1 Sep. 26, 2019

(51) Int. Cl.
*A61J 17/00* (2006.01)
*A61J 17/02* (2006.01)

(52) U.S. Cl.
CPC ..... *A61J 17/001* (2015.05); *A61J 17/02* (2013.01)

(58) Field of Classification Search
USPC ..... 606/234, 236
See application file for complete search history.

(56) References Cited

U.S. PATENT DOCUMENTS 3,610,248 A * 10/1971 Davidson ..... A61J 17/006 606/236
5,013,321 A * 5/1991 MacVane ..... A61J 17/006 215/11.5
6,482,225 B1 * 11/2002 Bingham ..... A61M 15/00 606/234
6,557,548 B1 * 5/2003 Dickson ..... A61M 15/00 128/200.24
8,985,357 B1 * 3/2015 Strayer ..... A61J 11/0005 215/11.1
2005/0214386 A1 * 9/2005 Shaheen ..... A61K 33/00 424/661
2006/0155331 A1 * 7/2006 Bohmer ..... A61J 17/006 606/234
2007/0021783 A1 * 1/2007 Viana ..... A61M 15/08 606/234
2007/0265661 A1 * 11/2007 Coleman ..... A61J 17/002 606/234
2009/0062855 A1 * 3/2009 Lemery ..... A61M 16/06 606/236
2012/0022446 A1 * 1/2012 Desai ..... A61J 7/0053 604/77
2013/0085475 A1 * 4/2013 McNac, III ..... A61J 17/006 604/514
2013/0331888 A1 * 12/2013 Antinnes ..... A61J 17/001 606/236
2014/0277135 A1 * 9/2014 DeLaurier ..... A61J 17/001 606/236
2015/0148740 A1 * 5/2015 McNac, III ..... A61J 17/006 604/77
2018/0117275 A1 * 5/2018 Becker ..... A61M 21/02
2018/0333336 A1 * 11/2018 Walker ..... A61J 17/006
2018/0369091 A1 * 12/2018 Avshalomov ..... A61K 36/185

FOREIGN PATENT DOCUMENTS

CA 2230395 A1 * 10/1999 ..... A61J 17/00
GB 201305884 * 5/2013 ..... A61J 11/003

* cited by examiner

*Primary Examiner* — Amy R Weisberg

(57) ABSTRACT

An infant intraoral device can include an intraoral portion and a sensory material carried by the intraoral portion. The intraoral portion may be formed of a biocompatible and food-safe polymeric material, with the intraoral portion being shaped and configured to sooth an infant upon one of sucking and chewing on the intraoral portion. The secondary sensory material can have one or more of a flavor or a scent associated therewith.

3 Claims, 7 Drawing Sheets

FLAVOR OR SCENT CARRYING PACIFIER OR TEETHING RING

BACKGROUND

Pacifiers have been in existence for many years to support the extra need for the infant to suckle. Pacifiers are typically made from latex or rubber materials with a mouth guard and a holding ring. Teething Rings are used to lessen the aggravation associated with new teeth breaking through the gums and help push new teeth through.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to an infant intraoral device. The infant intraoral device can include an intraoral portion and a sensory material carried by the intraoral portion. The intraoral portion may be formed of a biocompatible and food-safe polymeric material, with the intraoral portion being shaped and configured to sooth an infant upon one of sucking and chewing on the intraoral portion. The secondary sensory material can have one or more of a flavor or a scent associated therewith.

DRAWINGS

The Detailed Description is described with reference to the accompanying figures.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

Infant intraoral devices, such as pacifiers and teethers (e.g., teething rings), have proven to be useful tools for soothing infants and/or young children (e.g., supporting a need to suckle; or easing the aggravation associated with new teeth breaking through). However, these infant intraoral devices have typically been made of latex, rubber, silicone, or another biocompatible polymeric material, and such materials may have no taste or odor or, in other cases, may have an unpleasant taste or odor naturally associated therewith. Because of the taste and/or odor issues, some infants may reject taking the pacifier or teething ring outright or may only use it for brief periods of time. The infant intraoral devices in accordance with the present disclosure can incorporate or carry pleasant flavors and/or scents as part of the structure of infant intraoral device, thereby increasing the likelihood that an infant may better enjoy the pacifier, teething ring, or other infant intraoral device (e.g., bottle nipple).

Figure 1:
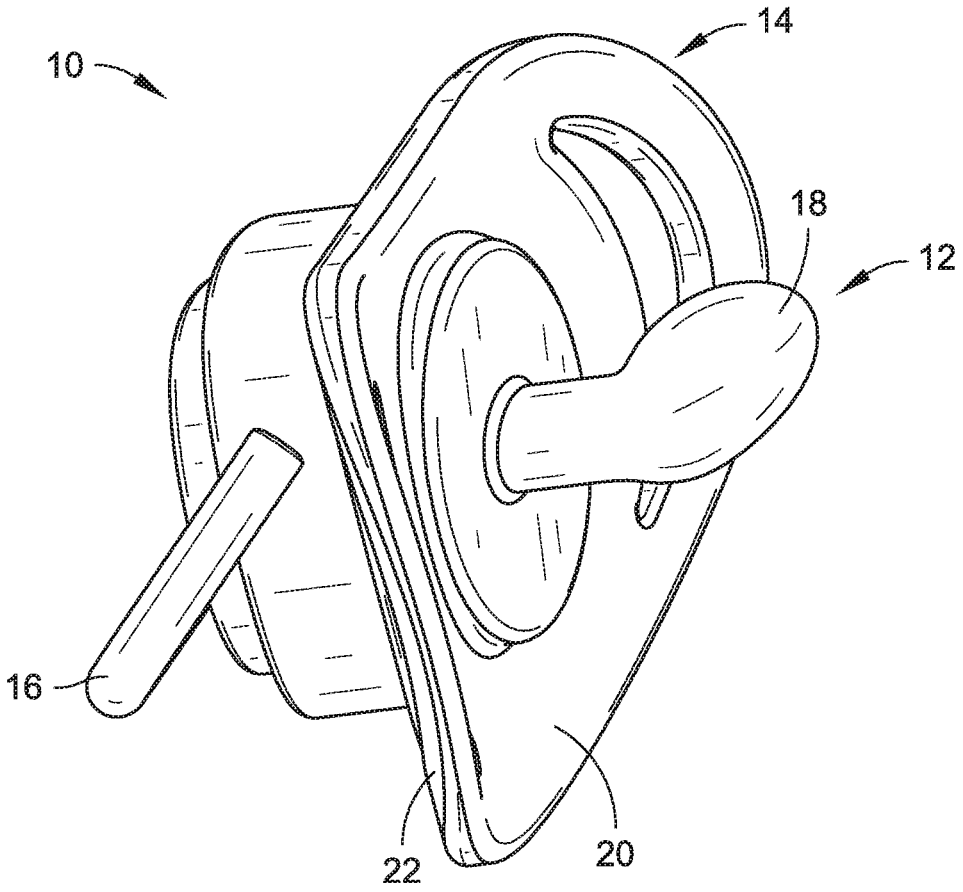
FIG. 1 is a side, isometric view of a pacifier in accordance with example embodiments of the present disclosure.
Figure 2:
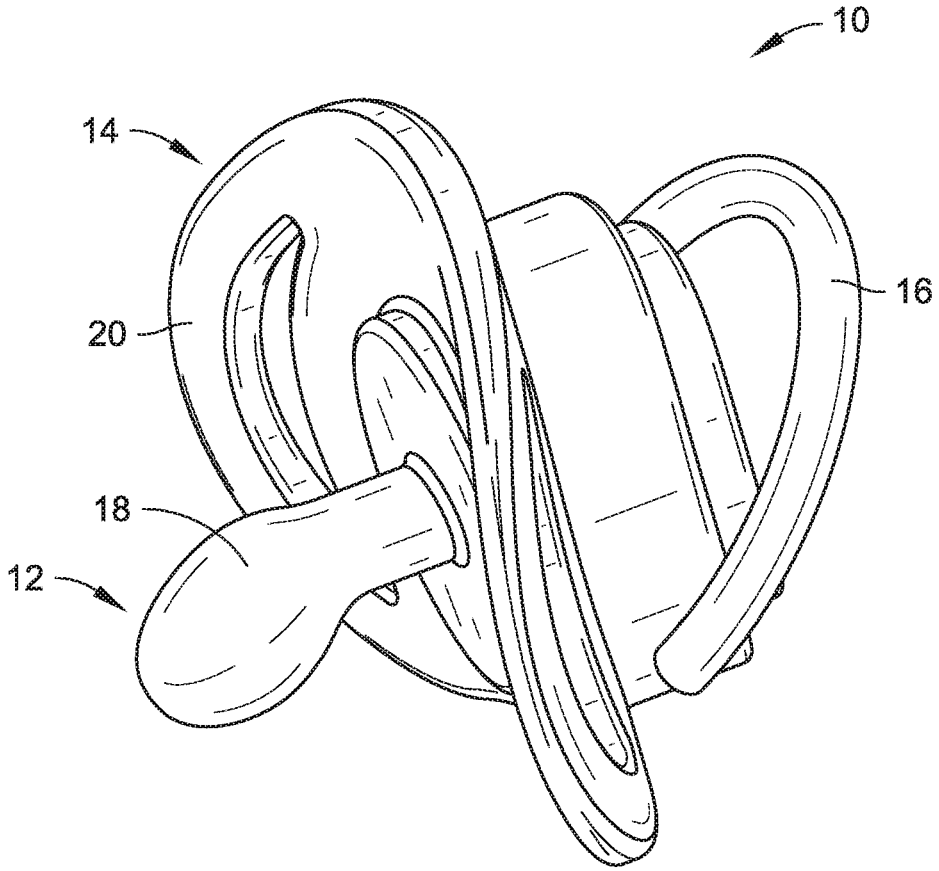
FIG. 2 is a bottom, isometric view of the pacifier shown in FIG. 1.

As shown in FIGS. 1 and 2, a pacifier 10 is one exemplary form of an infant intraoral device in accordance with an embodiment of the present disclosure and can generally include a nipple 12, a mouth shield 14, and a ring 16 (e.g., handle). The nipple 12 is configured to be sucked upon by an infant or a young child and, in some embodiments, may be in the form of an orthodontic and/or a natural fit nipple. Orthodontic nipples have a flattened portion and are designed to be similar in shape to a mother's nipple when breastfeeding. Orthodontic nipples are generally configured to fit the contour of an infant's or child's mouth, offer more room for the infant's or child's tongue to move, and/or promote the natural development of the jaw and teeth. Another exemplary nipple shape (not shown) is a simpler rounded shape. The nipple 12 shown in, for example, FIGS. 1 and 2 is the form of an orthodontic nipple. The nipple 12 may be made of a biocompatible and food-safe polymeric base material, and, for example, the base material may be a natural latex, an artificial latex, silicone, or ethylene vinyl acetate (EVA). In some embodiments, the nipple material may further be free of bisphenol A (BPA), polyvinyl chloride (PVC), and/or phthalate materials. In some embodiments, silver nanoparticles may be present in the base material to provide an antibacterial effect (e.g., 20-200 nm size and/or 0.1-1.0% by weight—the latter range chosen to provide sufficient antibacterial effect while not promoting discoloration). Broadly speaking, the nipple 12 of the pacifier 10 may made of any known base material used for producing such nipples and may take any form/shape used in the industry for pacifier nipples.

Further, the nipple 12 can have a sensory-enhanced exterior 18 (e.g., the region at or near the surface of the nipple 12). The sensory-enhanced exterior 18 may have one or more of a flavor (e.g., taste) or a scent (e.g., smell, odor) associated therewith not typically associated with the base material of the nipple 12. The sensory-enhanced exterior 18 can be achieved by providing a sensory material that is carried by the base material of the nipple 12. The sensory material can be carried by the base material in the form of one or more of an impregnant, a powdered additive, an embedded material, a dispersant, a solute (e.g., a flavoring extract soluble in ethanol or another appropriate solvent), or a layer. In one embodiment, enough of the sensory material is at or near the sensory-enhanced exterior 18 such that the taste and/or scent associated therewith may be detected by the infant or child using the pacifier 10. In some embodiments, the sensory material may be present in a range of 0.5%-5% by weight. In some embodiments, the appropriate range is dictated having enough present so the sensory material can be readily detected but not so much for the taste or scent to be overwhelming. In some embodiments, the flavor and/or scent may, for example, be that of a fruit, a common baby food, vanilla, a sweetener (e.g., sugar or an artificial one), a spice (e.g., cinnamon or nutmeg), mint, mother's milk, green tea, or another scent or flavor typically enjoyed by an infant or a child.

The mouth shield 14 can be configured to help retain the nipple 12 in place within an infant's or child's mouth (not shown) while the nipple 12 is being sucked and/or chewed upon. The mouth shield 14 may further be approximately heart-shaped, thus allowing the mouth shield 14 to rest comfortably on the lips and below the nose of the child. The mouth shield 14 further acts as an attachment base for both the nipple 12 and the ring 16. The mouth shield 14 defines a first shield side 20 and a second shield side 22. The nipple 12 may be attached (e.g., separately connected or integrally formed therewith) to the first shield side 20, while the ring 16 may be attached (e.g., separately connected or integrally formed therewith) to the second shield side 22. In the embodiment illustrated in FIGS. 1 and 2, the ring 16 is pivotally attached to the second shield side. The ring 16, which in some embodiments may be optional, can serve as a handle by which to hold the pacifier 10 (e.g., by the infant, parent, and/or caregiver) or as a tether-location (e.g., allowing the pacifier 10 to be attached via a tether and clip combination to a shirt, dress, or other piece of an infant's clothing). Additionally, in some embodiments, the mouth shield 14 and/or the ring 16 is sufficiently sized (e.g., large enough in cross-section) so as to reduce the opportunity of the pacifier 10 being accidentally swallowed by the child or infant using the pacifier 10.

In some embodiments, the mouth shield 14 and/or the ring 16 are made of a food-grade, biocompatible polymer. In some embodiments, the mouth shield 14 and ring 16 are made of the same material as the nipple 12, and in other embodiments, the mouth shield 14 and/or the ring 16 are made of a more structural and/or stiffer material such as a plastic. In further embodiments, the mouth shield 14 and the ring 16 may be stiffer than the nipple 12 yet still offer a degree of pliability and related comfort (e.g., especially the mouth shield 12 which rests upon the child's face). In some embodiments, the shield and/or ring material may further be free of bisphenol A (BPA), polyvinyl chloride (PVC), and/or phthalate materials. In some embodiments, silver nanoparticles may be present in the base material of the mouth shield 14 and/or the ring 16 to provide an antibacterial effect (e.g., 20-200 nm size and/or 0.1-1.0% by weight—the latter range chosen to provide sufficient antibacterial effect while not promoting discoloration).

In some embodiments, one or more of the mouth shield 14 and the ring 16 can carry an additional sensory material, the additional sensory material having one or more of a flavor or a scent associated therewith. Like with the nipple 12, the sensory material can be carried by the base material of the mouth shield 14 and/or the ring 16 in the form of one or more of an impregnant, an embedded material, a powdered additive, a dispersant, a solute, or a layer. In one embodiment, enough of the sensory material is at or near the surface/exterior (not labelled) of a given one of the mouth shield 14 or the ring 16 such that the taste and/or scent associated therewith may be detected by the infant or child using the pacifier 10. In some embodiments, the sensory material may be present in a range of 0.5%-5% by weight. In some embodiments, the appropriate range is dictated having enough present so the sensory material can be readily detected but not so much for the taste or scent to be overwhelming. In some embodiments, the flavor and/or scent may, for example, be that of a fruit, a common baby food, vanilla, a sweetener (e.g., sugar or an artificial one), a spice (e.g., cinnamon or nutmeg), mint, mother's milk, green tea, or another scent or flavor typically enjoyed by an infant or a child.

Figure 3:
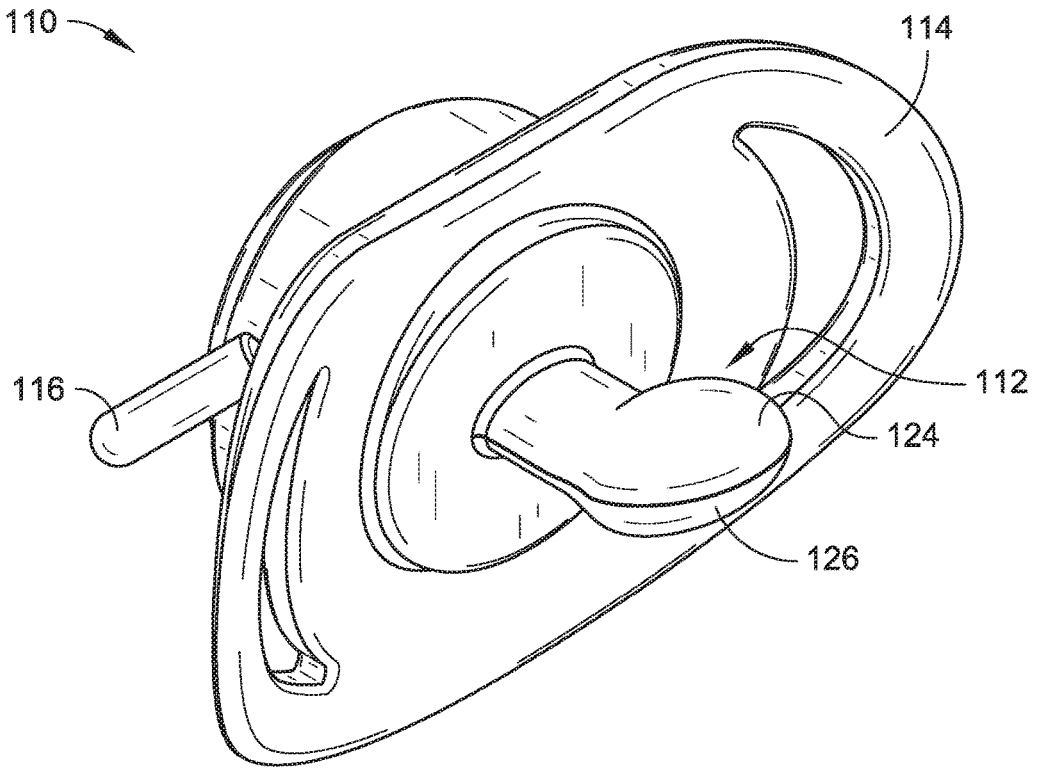
FIG. 3 is an isometric view of another pacifier in accordance with example embodiments of the present disclosure.

Referring now to FIG. 3, another pacifier 110 is described. The pacifier 110 generally may include a nipple 112, a mouth shield 114, and a ring 116 (e.g., handle). Like numbered parts as those associated with the pacifier 110 are expected to have the same general features and/or functionality as discussed above with respect to the pacifier 10, unless otherwise expressly described herein. The nipple 112 is in the form of an orthodontic nipple and has a top nipple side 124 and a bottom nipple side 126. The top nipple side 124 is configured to face a roof of an infant's mouth (not shown) when in use, while the bottom nipple side 126 is configured to face an infant's tongue (not shown) when in use. The top nipple side 124 is seen to be rounded, and the bottom nipple side 126 has a relatively flattened portion (not labelled). In the embodiment shown in FIG. 3, the top nipple side 124 is flavored and/or scented differently than the bottom nipple side 126. One or more of a flavoring or a scent associated with the nipple 112 is used with only one of the top nipple side 124 or the bottom nipple side 126. By flavoring and/or scenting the top nipple side 124 and the bottom nipple side 126 differently, such a difference may serve to promote the child or infant to use the orthodontic nipple in the orientation for which it was designed. That is, certain parts of the mouth have a greater concentration of saliva glands and/or taste buds, and a goal of the configuration of FIG. 3 is to provide a greater level of flavoring nearer to the saliva glands and/or taste buds when the nipple 112 is in its optimum orthodontic position.

Figure 4:
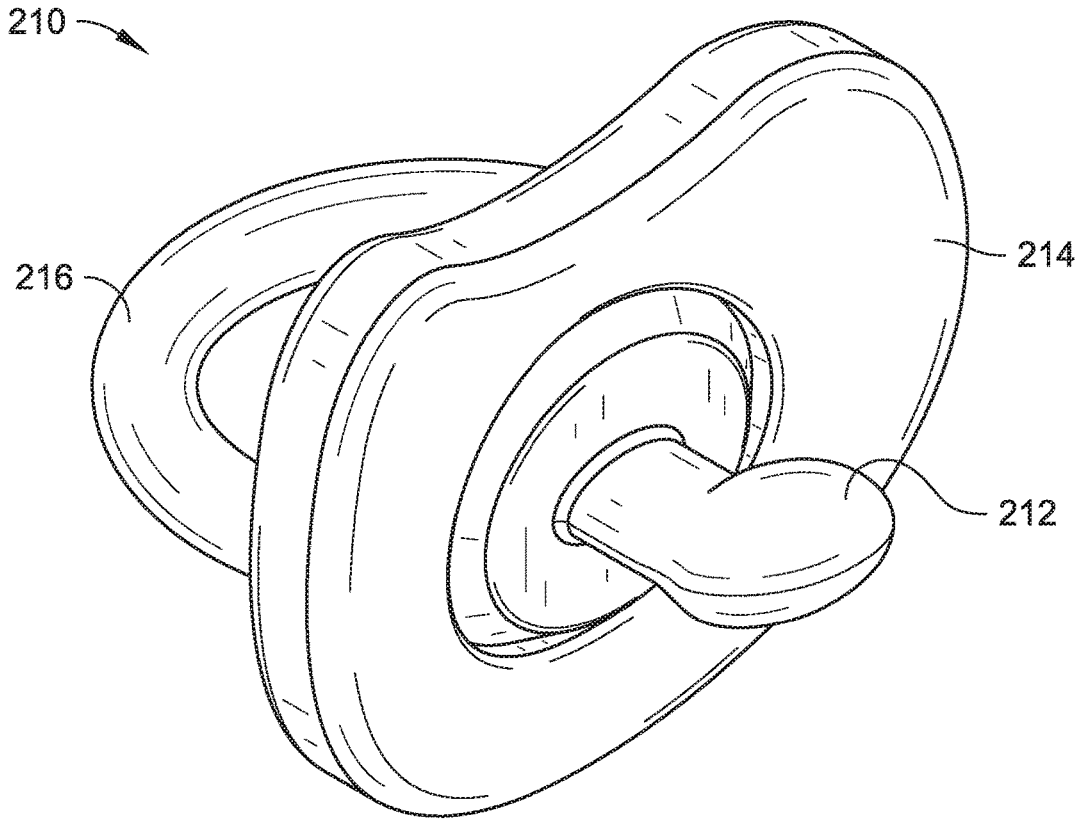
FIG. 4 is a side, isometric view of yet another pacifier in accordance with example embodiments of the present disclosure.

Referring now to FIG. 4, another pacifier 210 is described. The pacifier 210 generally may include a nipple 212, a mouth shield 214, and a ring 216 (e.g., handle). Like numbered parts as those associated with the pacifier 210 are expected to have the same general features and/or functionality as discussed above with respect to the pacifier 10, unless otherwise expressly described herein. The pacifier 210 differs primarily from pacifiers 10 and 110 in that the nipple 212, the mouth shield 214, and ring 216 are co-formed of a same base material. In some embodiments, the base material is chosen based on the material to be used for the nipple 212. A desired stiffness, particularly within the mouth shield 214, may be achieved by increasing the relative thickness of the mouth shield 214 relative to that used for the mouth shield 14 or 114. Overall, any pacifiers known in the art may be sensory-enhanced in the manner described herein and be deemed to be within the scope of the present disclosure.

Figure 5:
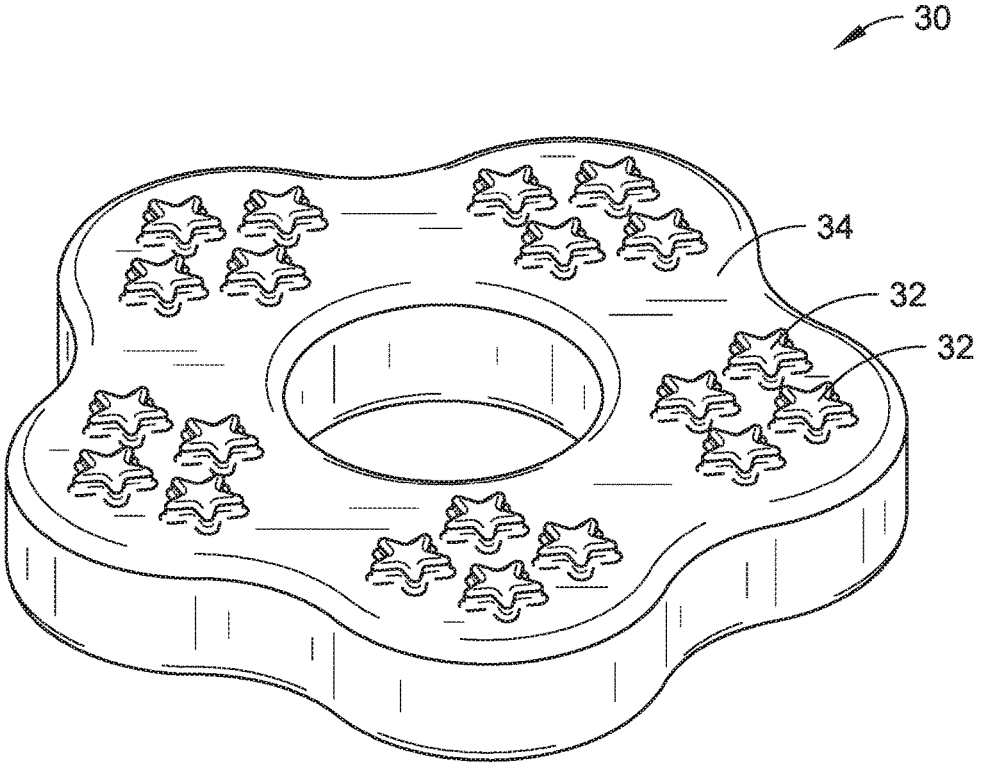
FIG. 5 is an isometric view of a teether in accordance with example embodiments of the present disclosure.

With respect to FIG. 5, a teether 30 (e.g., a teething ring) is shown, illustrating another form of an infant intraoral device in accordance with an embodiment of the present disclosure. The teether 30 is configured for easing the aggravation associated with new teeth breaking through. The aggravation may be eased, for example, by providing a texture 32 (e.g., provided in the form of stars in the illustrated version, but any raised bumps, symbols, shapes, etc., can suffice) on the teether 30, which can massage the gums, and/or by containing a food-grade gel or food-grade liquid that can be cooled or frozen, which can help lessen the effect of the pain associated with teething. The teether 30 can take any of the various forms as typically known in the art, with one common form being a teething ring, such as shown in FIG. 5.

The teether 30 can be made of a food-grade, biocompatible polymer. In some embodiments, the teether 30 can be made of the same base material as the nipple 12, and in other embodiments, the teether 30 may be made of a stiffer base material than the nipple 12 yet still offer a degree of pliability and related comfort (e.g., those materials used for the mouth shield 14 and/or the ring 16). In some embodiments, the teether 30 can be solid, while in some embodiments, it can be hollow, carrying a food-grade gel therein capable of being cooled and/or frozen (as stated above).

The teether 30 in accordance with an embodiment of the present disclosure can have a sensory-enhanced exterior 34. The sensory-enhanced exterior 34 may have one or more of a flavor (e.g., taste) or a scent (e.g., smell, odor) associated therewith not typically associated with the base material of the teether 30. The sensory-enhanced exterior 34 can be achieved by providing a sensory material that is carried by the base material of the teether 30. The sensory material can be carried by the base material in the form of one or more of an impregnant, an embedded material, a powdered additive, a dispersant, a solute (e.g., a flavoring extract), or a layer. In one embodiment, enough of the sensory material is at or near the sensory-enhanced exterior 34 such that the taste and/or scent associated therewith may be detected by the infant or child using the teether 30. In some embodiments, the sensory material may be present in a range of 0.5%-5% by weight. In some embodiments, the appropriate range is dictated having enough present so the sensory material can be readily detected but not so much for the taste or scent to be overwhelming. In some embodiments, the flavor and/or scent may, for example, be that of a fruit, a common baby food, vanilla, a sweetener (e.g., sugar or an artificial one), a spice (e.g., cinnamon or nutmeg), mint, mother's milk, or another scent or flavor typically enjoyed by an infant or a child.

In all of the various embodiments it is to be understood that the sensory material may be incorporated within the base material so as to be available over the full exterior of a given component or be selectively positioned so as to available only on portions of a given component. In yet some other embodiments, the sensory material may be available in higher concentrations at select regions of a component. For example, a scented material may be concentrated within a portion of a mouth shield 14, 114, and/or 214 that is to be closer to an infant's/child's nose (e.g., in the dipped portion of the heart shape (not labelled)). In another example, a flavoring may be concentrated on or within a nipple 12/112/212 at a location closest to an infant's/child's taste buds.

Figure 6:
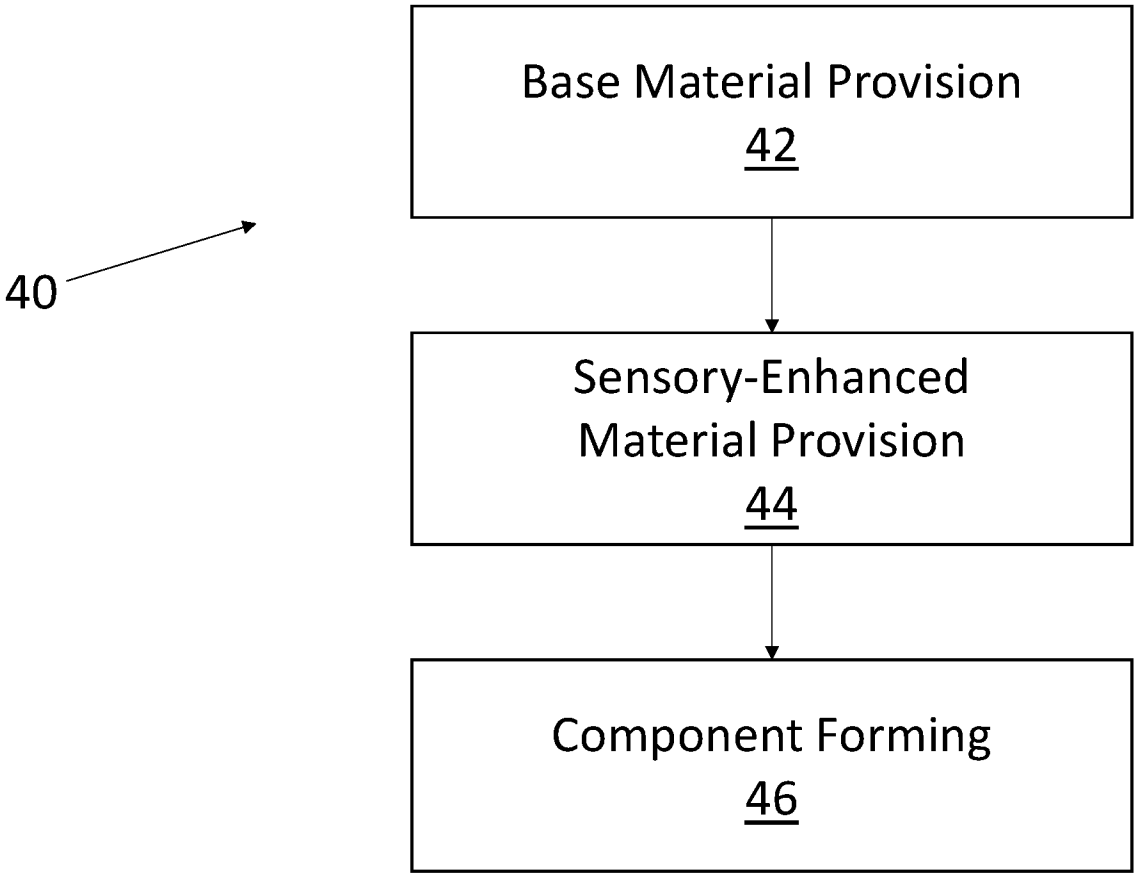
FIG. 6 is a flow chart showing a process for making an infant intraoral device in accordance with example embodiments of the present disclosure.
Figure 7:
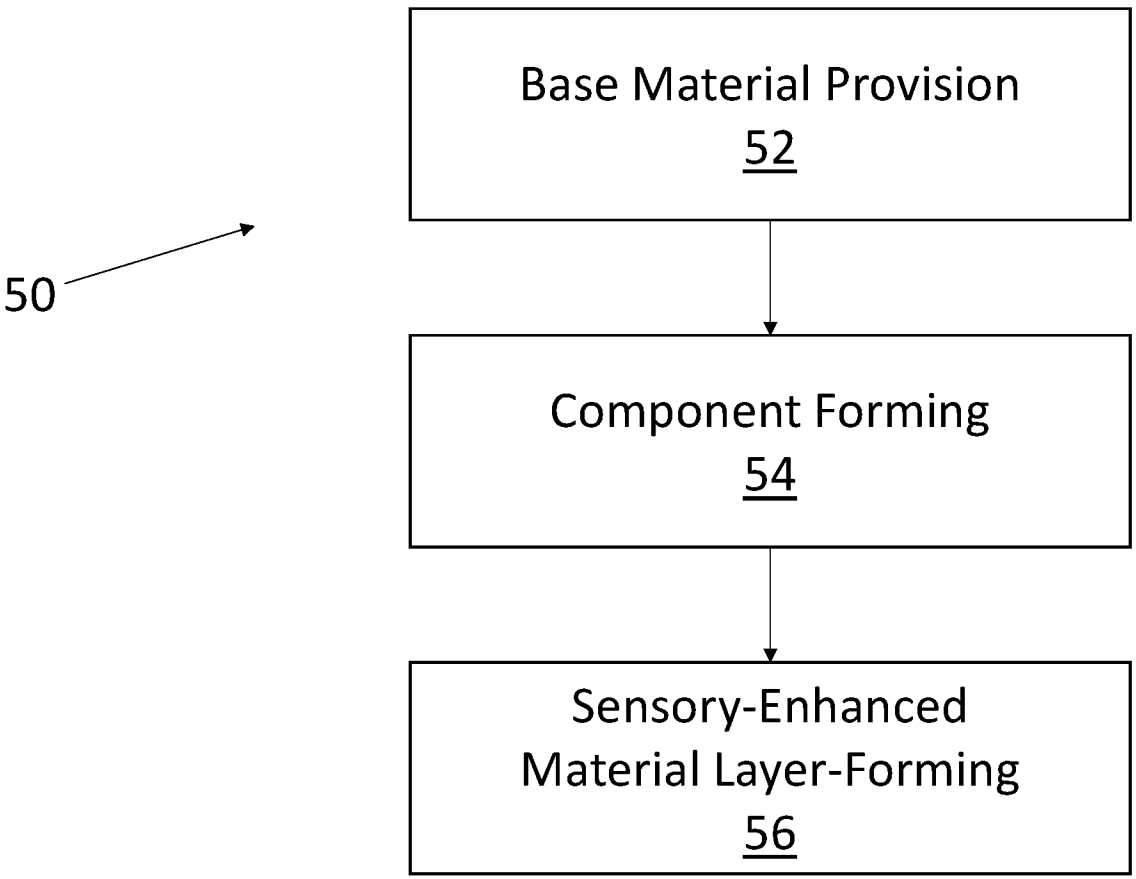
FIG. 7 is a flow chart showing another process for making an infant intraoral device in accordance with example embodiments of the present disclosure.

FIGS. 6 and 7 illustrate exemplary methods according to embodiments of the present disclosure by which a sensory-enhanced component of an infant intraoral device may be made. The process 40, set forth in FIG. 6, includes a base material provision step 42, a sensory-enhanced material provision step 44, and a component forming step 46. In the base material provision step 42, a chosen base material (e.g., such as those set forth for the nipple, mouth shield, and/or ring of a given pacifier; or for the teether) is provided. In the sensory-enhanced material provision step 44, the sensory-enhanced material (such as one of those set forth above) may be mixed, dissolved, or otherwise incorporated into the base material and done so in a manner such that at least a portion of the sensory-enhanced material is carried at or near the component exterior. The combined base material and sensory-enhanced material thus establish the combined component material. The combined component material is then subjected to the component forming step 46 (e.g., molding, extruding, etc.), thereby yielding a desired sensory-enhanced component of an infant intraoral device. Of course, it is to be understood that other process steps that are not described may be included and still be within the scope of process 40.

The process 50, as shown in FIG. 7, provides another method by which a sensory-enhanced component of an infant intraoral device may be made. The process 50 includes a base material provision step 52, a component forming step 54, and a sensory-enhanced material layer-forming step 56. The base material provision step 52 can be like the base material provision step 42, and the component forming step 54 may be similar to the component forming step 46. Where the processes 40 and 50 differ is mainly when and where the sensory-enhanced material is provided. In the process 50, the sensory-enhanced material is provided as part of the layer-forming step 56 that happens after the component forming step 54. The layer of the sensory-enhanced material may be in the form of a stand-alone coating, a material carried by an additional coating matrix, or a material embedded into the exterior of the formed component (e.g., in the latter instance, the sensory-enhanced material layer may be continuous or discontinuous). By using the layer-forming step 56, the sensory-enhanced material may be concentrated at or near an exterior of the component being formed. Also, by performing the layer-forming step 56 after the component forming step 54, the sensory-enhanced material need not be exposed to the heat, pressure, etc., associated with the component forming step, which may improve the lifetime, etc., of the sensory-enhanced material.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An infant pacifier, comprising:

a nipple;

a mouth shield, and a ring;

the mouth shield having a first shield side and a second shield side, the nipple being attached to the first shield side of the mouth shield, the ring being attached to the second shield side of the mouth shield;

wherein the nipple has a top nipple side and a bottom nipple side, the top nipple side being configured to face a roof of an infant's mouth when in use, the bottom nipple side being configured to face an infant's tongue when in use, the top nipple side being flavored or scented differently than the bottom nipple side.

2. An infant pacifier, comprising:

a nipple;

a mouth shield, and a ring;

the mouth shield having a first shield side and a second shield side, the nipple being attached to the first shield side of the mouth shield, the ring being attached to the second shield side of the mouth shield;

wherein the nipple has a top nipple side and a bottom nipple side, the top nipple side being configured to face a roof of an infant's mouth when in use, the bottom nipple side being configured to face an infant's tongue when in use;

wherein the nipple comprises a first flavor or scent; and wherein the ring and mouth shield comprise a second flavor or scent different from the first flavor or scent.

3. An infant pacifier, comprising:

a nipple;

a mouth shield, and a ring;

the mouth shield having a first shield side and a second shield side, the nipple being attached to the first shield side of the mouth shield, the ring being attached to the second shield side of the mouth shield;

wherein the nipple has a top nipple side and a bottom nipple side, the top nipple side being configured to face a roof of an infant's mouth when in use, the bottom nipple side being configured to face an infant's tongue when in use;

wherein the nipple comprises a first flavor or scent;

wherein the ring comprise a second flavor or scent;

wherein the mouth shield comprises a third flavor or scent; and wherein the first, second and third flavors or scents are different.

* * * * *